United States Patent [19]

Troyen

[11] Patent Number: 4,765,652

[45] Date of Patent: Aug. 23, 1988

[54] PERMANENT BOOK MARK

[76] Inventor: Harry D. Troyen, 906 N. 25th St., Reading, Pa. 19606

[21] Appl. No.: 907,306

[22] Filed: Sep. 11, 1986

[51] Int. Cl.[4] ..... B42D 9/00

[52] U.S. Cl. ..... 281/42

[58] Field of Search ..... 281/15 R, 42, 38, 25 R, 281/25 A, 21 R, 21 A

[56] References Cited

FOREIGN PATENT DOCUMENTS

| | | | |
|---|---|---|---|
| 530092 | 9/1956 | Canada | 281/42 |
| 471935 | 2/1929 | Fed. Rep. of Germany | 281/42 |
| 851491 | 10/1952 | Fed. Rep. of Germany | 281/42 |
| 1108475 | 1/1956 | France | 281/42 |
| 585130 | 1/1947 | United Kingdom | 281/42 |

*Primary Examiner*—Paul A. Bell

*Attorney, Agent, or Firm*—Leonard M. Quittner

[57] ABSTRACT

A book mark is disclosed which is an extension of a book's endpaper or flyleaf and folded such that the fold coincides with the width of the book page and the extension folds inwardly to mark a place in the book. The book mark may be made as a separate endpaper extension by folding a sheet of paper of defined length along its longitudinal axis to form a major portion and a minor portion which has adhered to its outfold surface adhesive for attachment to the endpaper or flyleaf such that the outer edge of the endpaper or flyleaf coincides with the fold and the extension folds inwardly to mark a place in the book.

1 Claim, 2 Drawing Sheets

FIG. 1
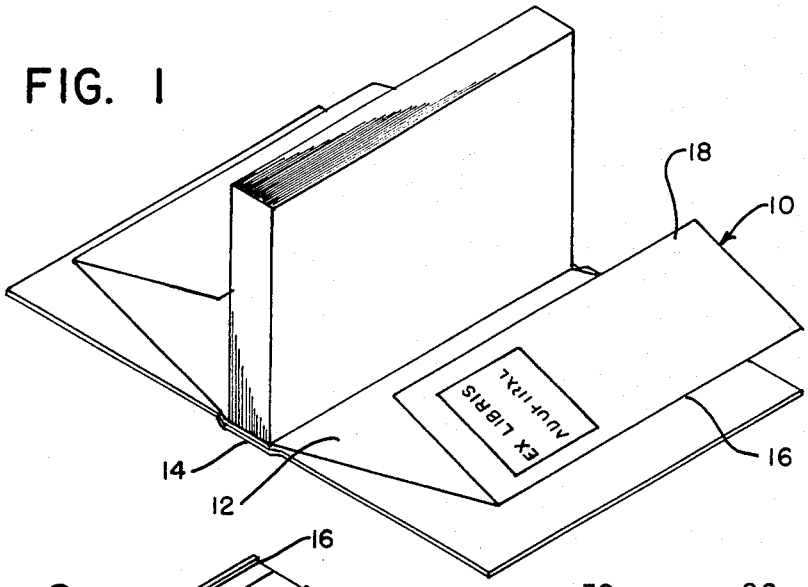
FIG. 2
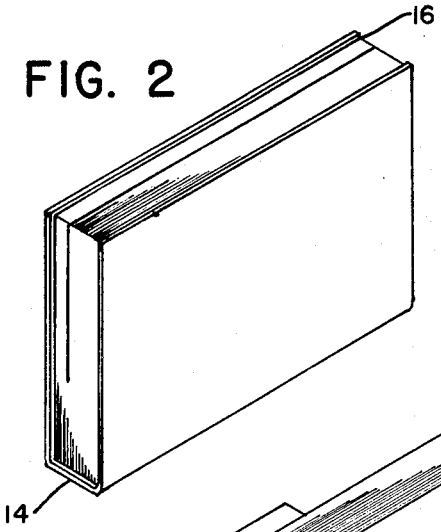
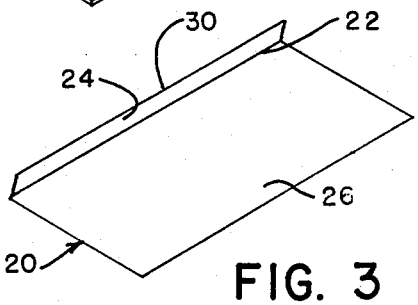
FIG. 3
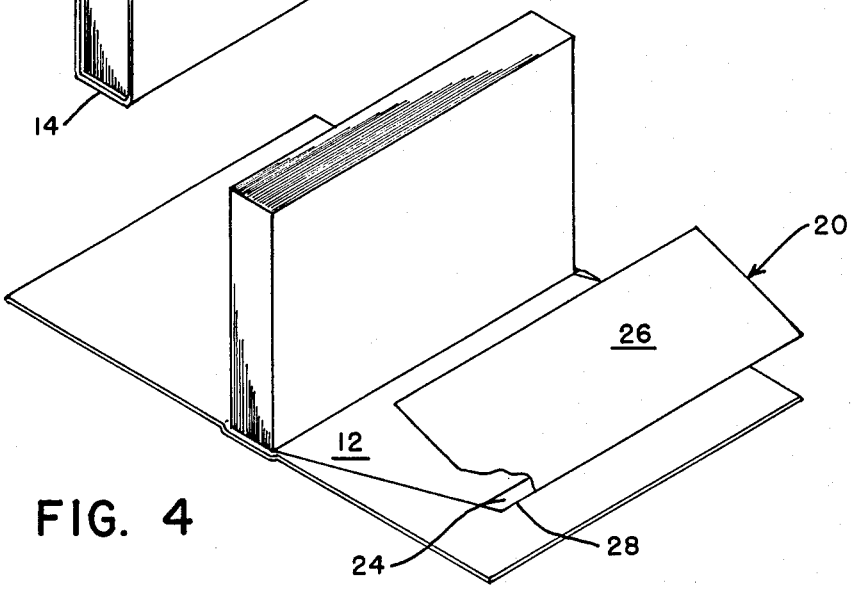
FIG. 4

PERMANENT BOOK MARK

CROSS-REFERENCE

There are no cross-references to nor are there any related applications.

FEDERALLY-SPONSORED RIGHTS

The invention herein was made without any Federal sponsorship or contribution.

BACKGROUND OF THE INVENTION

1. The Field of the Invention

The field of the invention relates to an improved book mark which is made of paper and which is a planar extension of an endpaper or flyleaf.

2. Description of the Prior Art

The prior art is best demonstrated by U.S. Pat. Nos. 4,487,430 to Bernardin, 4,184,699 to Lowe; 3,324,823 to Peters; 33,231,296 to Margolis; 3,159,137 to Baldwin; 2,541,375 to Albrecht; 2,405,374 to Singer; 1,895,616 to Farmer and 1,829,282 to Irwin.

U.S. Pat. No. 3,324,823 shows a loose page insert for marking off or delineating sections in text books and the like; U.S. Pat. Nos. 2,405,374 and 3,159,137 show a marker which infolds from above the page and is adhered of necessity to the cover. U.S. Pat. No. 1,829,282 shows a marker which is an extension of the plane of the cover and is integral therewith.

As is well-known dust jackets have served as book marks for years. These become tattered, dirty, lost or discarded in time, and therefore useless as book marks.

The present invention provides a radical but inexpensive improvement in book construction, the result of which is a book mark which also can function as a display page. The book mark is fabricated as a planar, infolded extension of the endpaper, with the fold being located longitudinally adjacent to the outer edge of the book cover where the endpaper is glued to the cover's inside surface and the extension, now free to fold, is of a width less than the book's page width. Alternatively, the configuration may be an constructed as part of a flyleaf, with the infolded extension compising the outer portion of the flyleaf. A further modification comprises the extension fabricated separately folded into a wide portion and a narrow portion which is adhered to the outboard edge endpaper or flyleaf.

SUMMARY OF THE INVENTION

The invention described herein is summarized as a book mark which is a permanent planar, infolded extension of a front or back endpaper in a book having bound pages and constructed such that the endpaper has a longitudinal fold forming an inboard portion wider than an outboard portion the inboard portion being glued as the endpaper is customarily adhered to the book cover and the outboard portion extends outward planarly in width a substantial distance somewhat less than the width of a book page and infolded longitudinally toward the book's spine such that the fold coincides with the endpaper's outer longitudinal edge and the infolded extension marks a place in the book. The bookmark can be fabricated as an identical permanent planar extension of a flyleaf in a book having bound pages and constructed such that the flyleaf extends outwardly from the fold in width a substantial distance somewhat less than the width of a page end infolded to mark a place in the book. Yet another alternative is an extension sheet which is fabricated from paper of a length no greater than a bound book page and infolded longitudinally so as to create an outboard major portion outward of the fold and which is substantially larger than the remaining inboard minor portion but narrower in width than the book page, the minor portion having adhesive on its outfold surface for attachment to the outboard portion of the endpaper or flyleaf such that the fold coincides with the outer longitudinal edge of the endpaper or flyleaf and when folded inward the extension marks a place in the book.

An object of the invention is to provide a permanent book mark which is usable from the front or rear of the book.

A further object of the invention is to provide an extension to an endpaper which widens the plane of the endpaper a defined width less than a page width and which functions as a book mark.

It will be obvious to those skilled in the art that the invention herein will function as a display page as well as a book mark.

Other objects, advantages and features of the present invention will be apparent to those skilled in the art from the following description taken in conjunction with the accompanying drawings.

DESCRIPTION OF DRAWINGS

The present invention may be better understood by reference to the drawings wherein five (5) figures are shown on two (2) sheets. The numbers shown on the drawings for the various parts of the invention are consistent throughout so that a number indicating a part in one drawing will indicate the same part in another drawing. FIG. 1 shows a perspective view of a book constructed with permanent flyleaf book marks; FIG. 2 shows a closed book with an endpaper or flyleaf book mark in use; FIG. 3 shows an extension sheet having an adhesive portion and folded for mounting on an endpaper or a flyleaf; FIG. 4 shows the extension sheet mounted to a flyleaf.

DESCRIPTION OF THE PREFERRED EMBODIMENTS

Figure 1A:
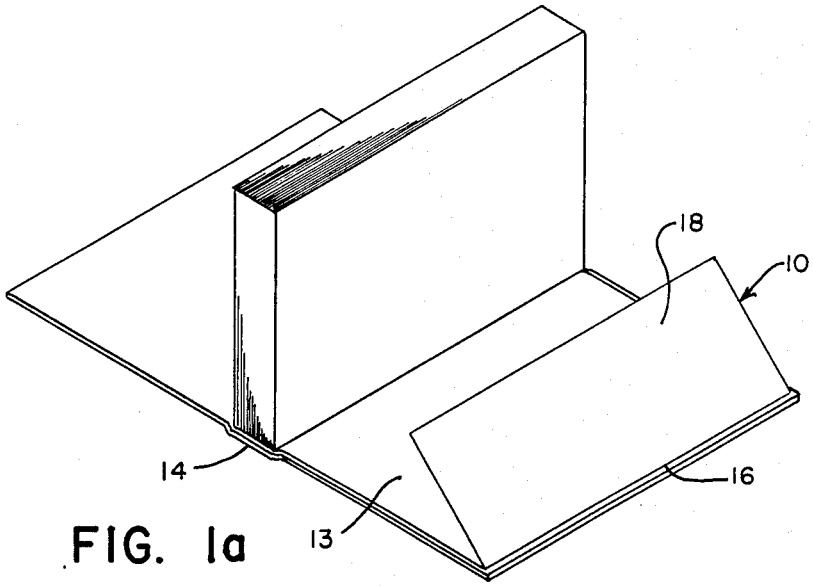
FIG. 1*a* shows a perspective view of a book showing the invention glued down to the cover as an endpaper with an extension.

The preferred embodiments are described first as comprising a planar extension (10) of a flyleaf (12) of a book (14) of either of hard or soft cover, folded (16) along its length such that the extension is formed at the flypaper's longitudinal edge, a substantially defined width from the fold (16) but less than the width of a page. A second variant is to form the extension on an endpaper and to glue the endpaper down onto the inside surface of the cover, as is customary in the trade, and leave the extension free (See FIG. 1*a*). For books which are already in use, the book owner may attach a pre-cut (20) and prefolded (22) planar extension sheet having a major infolded portion (26) and a minor portion (24) which is adhered to the endpaper or flyleaf's outboard edge (28) by means of adhesive (30) applied to the outfold side of the minor portion of the prefolded extension.

As is apparent to one skilled in the art, the extended page, or the extension piece variant, leaves a blank surface which may be used for a variety of display purposes.

What claimed is:

1. A bound book having a cover, a spine, pages and a flyleaf;

the pages and the flyleaf having a dimension in length as measured along a line parallel to the elongated axis of the spine and a dimension in width measured along a line perpendicular to the elongated axis of the spine and the pages and the flyleaf being of the same length, the improvement comprising:

the flyleaf having a dimension in width substantially greater than the width of the pages but less than twice the width of the pages whereby the free end of the fly leaf extending beyond the width of the pages may be turned over and selectively inserted between adjacent pages to serve as a book mark.

* * * * *